US011802414B2

(12) United States Patent
Tian et al.

(10) Patent No.: US 11,802,414 B2
(45) Date of Patent: Oct. 31, 2023

(54) BOLT-BEARING CIRCUMFERENTIAL DEVICE FOR REINFORCING AND CORRECTING ANGLE IRONS OF TRANSMISSION TOWER

(71) Applicant: SHANDONG UNIVERSITY, Shandong (CN)

(72) Inventors: Li Tian, Jinan (CN); Meng Yang, Jinan (CN); Juncai Liu, Jinan (CN); Xianchao Luo, Jinan (CN); Xiaoyang Wang, Jinan (CN); Zhen Ma, Jinan (CN); Xiangrui Meng, Jinan (CN)

(73) Assignee: SHANDONG UNIVERSITY, Jinan (CN)

( * ) Notice: Subject to any disclaimer, the term of this patent is extended or adjusted under 35 U.S.C. 154(b) by 0 days.

(21) Appl. No.: 17/917,172

(22) PCT Filed: Mar. 9, 2022

(86) PCT No.: PCT/CN2022/079996
§ 371 (c)(1),
(2) Date: Oct. 5, 2022

(87) PCT Pub. No.: WO2023/040214
PCT Pub. Date: Mar. 23, 2023

(65) Prior Publication Data

US 2023/0272634 A1 Aug. 31, 2023

(30) Foreign Application Priority Data

Sep. 15, 2021 (CN) ..... 202111080586.3

(51) Int. Cl.
*E04G 23/02* (2006.01)

(52) U.S. Cl.
CPC ..... *E04G 23/0218* (2013.01)

(58) Field of Classification Search
CPC ..... E04G 23/0218; F16B 2200/506; F16B 5/0685; F16B 5/0607; F16B 5/0692;
(Continued)

(56) References Cited

U.S. PATENT DOCUMENTS 1,403,051 A * 1/1922 Moore ..... E04H 12/10 52/638
1,599,742 A * 9/1926 Black ..... E04H 12/10 52/651.06

(Continued)

FOREIGN PATENT DOCUMENTS

AT 3748 U1 * 7/2000
CN 206448599 U 8/2017

(Continued)

OTHER PUBLICATIONS

Jun. 16, 2022 International Search Report issued in International Patent Application No. PCT/CN2022/079996.

(Continued)

*Primary Examiner* — Theodore V Adamos
(74) *Attorney, Agent, or Firm* — Oliff PLC

(57) ABSTRACT

Provided a bolt-bearing circumferential device for reinforcing and correcting an angle iron of a transmission tower, comprising a reinforcing angle iron, a holding hoop, and a connector; the reinforcing angle iron is arranged at an inner side of two limbs of an angle iron to be reinforced, an axis direction of the reinforcing angle iron is parallel to the angle iron to be reinforced, and an outer wall of two limbs of the reinforcing angle iron are fitted with an inner wall of the angle iron to be reinforced; the holding hoop is arranged at an outer side of the reinforcing angle iron and the angle iron to be reinforced, and each part of the holding hoop are connected together through the high-strength bolts; a side wall of the holding hoop is provided with three groups of threaded holes, wherein an axis of a first group of the (Continued)

threaded holes and an axis of a second group of the threaded holes are perpendicular to each other, a first group of bolts pass through the first group of the threaded holes to apply a reinforcing force to an outer side of a first limb of the angle iron to be reinforced, and a second group of bolts pass through the second group of the threaded holes to apply a reinforcing force to an outer side of a second limb of the angle iron to be reinforced; and, a third group of bolts pass through a third group of the threaded holes to apply a reinforcing force to the reinforcing angle iron through the connector.

8 Claims, 4 Drawing Sheets

(58) Field of Classification Search
CPC ..... F16B 2200/509; E04H 12/10; E04B 1/18; E04B 1/24
See application file for complete search history.

(56) References Cited

U.S. PATENT DOCUMENTS 1,729,743 A * 10/1929 Aage ..... E04B 1/2403 52/653.1
2,073,889 A * 3/1937 Trout ..... E04G 23/0218 52/656.1
2,145,232 A * 1/1939 Bauer ..... E04H 12/10 52/651.01
2,664,636 A * 1/1954 Schneider ..... E04G 21/1808 33/406
3,007,232 A * 11/1961 Thiry ..... E04H 12/10 52/645
6,454,232 B1 * 9/2002 Roth ..... F16B 7/0433 248/229.24
7,918,425 B2 * 4/2011 Rathbone ..... H01Q 1/1228 343/890
8,061,096 B2 * 11/2011 Kim ..... E04C 3/32 52/223.14
11,286,680 B2 * 3/2022 Komatsu ..... E04H 12/10
2003/0172612 A1 * 9/2003 Simmons ..... E04B 1/24 52/648.1
2011/0239585 A1 10/2011 Kim

FOREIGN PATENT DOCUMENTS

CN 107178242 A 9/2017
CN 107386759 A 11/2017
CN 207048441 U 2/2018
CN 109025459 A 12/2018
CN 109138479 A 1/2019
CN 209620739 U 11/2019
CN 110700675 A 1/2020
CN 111058672 A 4/2020
CN 111576982 A 8/2020
CN 212642294 U 3/2021
CN 213205035 U 5/2021
CN 113027218 A 6/2021
CN 113152975 A 7/2021
CN 214330155 U 10/2021
CN 113789973 A 12/2021
EP 1739243 A1 * 1/2007 ..... E04B 1/24
EP 2270288 A1 1/2011
JP 2013-151832 A 8/2013
JP 2013-160023 A 8/2013
JP 2016-125203 A 7/2016
JP 6591026 B1 10/2019
KR 20140137593 A * 12/2014

OTHER PUBLICATIONS

Jun. 16, 2022 Written Opinion issued in International Patent Application No. PCT/CN2022/079996.
Mar. 30, 2022 Office Action issued in Chinese Patent Application No. 202111080586.3.

* cited by examiner

BOLT-BEARING CIRCUMFERENTIAL DEVICE FOR REINFORCING AND CORRECTING ANGLE IRONS OF TRANSMISSION TOWER

CROSS-REFERENCES TO RELATED APPLICATIONS

This application claims priority benefits to Chinese Patent Application No. 202111080586.3, filed 15 Sep. 2021, the contents of which are incorporated herein by reference.

TECHNICAL FIELD

The present invention relates to the reinforcement technology of the transmission tower structure, especially relates to a bolt-bearing circumferential device for reinforcing and correcting angle irons of a transmission tower.

BACKGROUND

At present, the transmission tower structure itself has the defects of insufficient bearing capacity or later damage, which eventually leads to the destruction of components and even the collapse of the transmission tower structure, seriously affecting people's normal production and life, and even more serious, it can affect the development of the disaster rescue work. For the angle iron members of the transmission tower that have been buckled, although the angle iron members with slight damage can still be used, they can only be replaced because of the deformation, which causes a large waste of material resources. Therefore, it is of great significance to improve the ability of the power grid to resist natural disasters, strengthen and protect the transmission tower in service, and repair the damaged poles of the transmission tower to ensure the safe and stable operation of the power grid and power supply safety under serious natural disasters.

At present, there are two main types of transmission tower reinforcement ideas: one is to add auxiliary materials on the main materials of the transmission tower by a variety of methods, or directly replace the weak components which are easy to be damaged in the original structure with components of another specification, so as to strengthen the bearing capacity of the components, thereby achieving the purpose of improving the stability of the iron tower; the other one is to increase the shear resistance and overall stability of the weak area between the sections of the transmission tower by adding transverse diaphragms between the sections, so as to improve the overall bearing capacity of the structure. However, most of the current reinforcement methods need to drill holes on the original members of the transmission tower, which weakens the original member and affects the force transmission path and bearing capacity of the transmission tower; or, temporary removals the original forced components, which will cause the redistribution of internal force in the tower members of the iron tower, then make the force situation of a rod piece in the transmission tower more complex, and lead to the uncertainty of the bearing capacity of the transmission tower.

SUMMARY

Based on the above research status, the purpose of the present invention is to provide a bolt-bearing circumferential device for reinforcing and correcting an angle iron of a transmission tower, which is a detachable device for buckling prevention, reinforcement and correction of angle iron deformation for the transmission tower being suitable for the angle iron members and mainly proposed for the reinforcement of transmission tower.

The present invention uses the following technical solutions:

According to the present invention, proposed a bolt-bearing circumferential device for reinforcing and correcting an angle iron of a transmission tower, including a reinforcing angle iron, a holding hoop, a connector, a high-strength bolt and bolts; the reinforcing angle iron is arranged at an inner side of two limbs of an angle iron to be reinforced, an axis direction of the reinforcing angle iron is parallel to the angle iron to be reinforced, outer walls of the two limbs of the reinforcing angle iron are fitted with an inner wall of the angle iron to be reinforced; the holding hoop is arranged at an outer side of the reinforcing angle iron and the angle iron to be reinforced, and is connected through the high-strength bolts; a side wall of the holding hoop is provided with three groups of threaded holes, wherein axes of a first group of the threaded holes and a second group of the threaded holes are perpendicular to each other, a first group of bolts pass through the first group of the threaded holes to apply a reinforcing force to an outer side of a first limb of the angle iron to be reinforced, and a second group of bolts pass through the second group of the threaded holes to apply a reinforcing force to an outer side of a second limb of the angle iron to be reinforced; and a third group of bolts pass through a third group of the threaded holes to apply a reinforcing force to the reinforcing angle iron through the connector.

Further, the connector includes a connector support, a pin, and a support spacer, the support spacer is connected to two the connector supports via the pin, and the two connector supports and the support spacer is able to rotate around the pin.

Further, the connector support includes a bolt sleeve and a bolt, a first end of the bolt sleeve is connected to the pin and a second end of the bolt sleeve is matched with a bolt being pressed against the reinforcing angle iron.

According to the present invention, a reinforcement effect of the reinforcing device can be adjusted by changing a diameter of the threaded hole, a diameter of the three groups of bolts, the number of the threaded holes and adjusting an angle of the connector and a length of the support on both sides of the connector; for the angle iron to be reinforced with special reinforcement requirements, the reinforcing angle iron or the holding hoop can be fully extended along the axial direction of the angle iron to be reinforce, so as to improve the compressive bearing capacity of whole the angle iron to be reinforced; for the angle iron component of the transmission tower with slight buckling deformation, after installing the holding hoop in the deformation position, the pitch of the bolt on a middle arc steel plate can be adjusted to realize a jacking of a drum-shaped angle iron component, so as to reset the drum-shaped angle iron component; and the pitch of the bolt on left and right arc steel plates can also be adjusted to realize the constraint on the position of the angle iron component, so as to prevent excessive correction.

The beneficial effects of the present invention are:

1. According to the present invention, proposed a bolt-bearing circumferential device for reinforcing and correcting an angle iron of a transmission tower, may reinforce the angle iron members with insufficient bearing in the transmission tower according to the reinforcement requirements, and may correct and repair the angle iron member of the transmission tower which is subjected to buckling damage, which effectively improve the overall stable bearing capacity of the transmission tower.

2. According to the present invention, there is no need to drill holes in the raw materials of the transmission tower on site, which effectively avoids the problem of the difficulty of construction caused by the great difficulties in obtaining electricity for construction due to the locations of some transmission towers to be reinforced are in remote areas.

3. According to the present invention, there is no need to temporarily remove the original forced components, which avoids complex redistribution of internal force generated in local areas, in which can cause the transmission tower in a dangerous state in the reinforcement process.

4. According to the present invention, there are three groups of the threaded holes provided on the side wall of the holding hoop, wherein the axes of the left and right groups of the threaded holes are perpendicular to each other, and the third group of the threaded holes are distribute at equal intervals corresponding to the left and right groups of the threaded holes; each the threaded hole applies a certain force to the angle iron to be reinforced or the reinforcing angle iron through the corresponding bolt.

5. According to the present invention, the device has the advantages of simple construction, convenient maintenance and obvious effect, which can effectively improve the bearing capacity and overall stability of the transmission tower members.

BRIEF DESCRIPTION OF THE DRAWINGS

In order to more clearly illustrate the examples of the present invention or the technical solutions in the prior art, the following will briefly introduce the drawings needed to be used in the description of the examples or the prior art.

In figures: 1, angle iron to be reinforced; 2, reinforcing angle iron; 3, first holding hoop; 4, second holding hoop; 5, high-strength bolt; 6-1, connector support; 6-1-1, bolt sleeve; 6-1-2, bolts; 6-2, pin; 6-3, support spacer; 7, rubber gasket; 8-1, bolt; 8-2, bolt; 8-3, bolt.

DETAILED DESCRIPTION

It should be pointed out that the following detailed descriptions are all illustrative and are intended to provide further descriptions of the present invention. Unless otherwise specified, all technical and scientific terms used in the present invention have the same meanings as those usually understood by a person of ordinary skill in the art to which the present invention belongs.

It should be noted that the terms used herein are merely used for describing specific implementations, and are not intended to limit exemplary implementations of the present disclosure. As used herein, the singular form is also intended to include the plural form unless the context clearly dictates otherwise. In addition, it should further be understood that, terms "comprise" and/or "include" used in this specification indicate that there are features, steps, operations, devices, components, and/or combinations thereof.

For the purpose of description, if the words "upper", "lower", "left", "right" appear in this application, they only means that they are consistent with the up, down, left and right directions of the drawings themselves, and does not limit the structure, but is only for the purpose of describing the invention and simplifying the description, and does not indicate or imply that the equipment or components referred to must have a specific orientation, be constructed and operated in a specific orientation, and therefore cannot be construed as a limitation of this application.

Compared with other reinforcing devices, according to the present invention, the device may adapt to the action of multiple load patterns and effectively improves the overall stability and the bearing capacity of the transmission tower. According to the present invention, the device is completely an assembly-type, without the need for on-site drilling of the raw materials of the transmission tower, thus effectively avoiding damage to the overall structure of the transmission tower and reducing the construction difficulty; without the need for temporary disassembly of the original forced components, to prevent the redistribution of internal force and the iron tower in a dangerous state in the process of reinforcement caused thereby.

Figure 1:
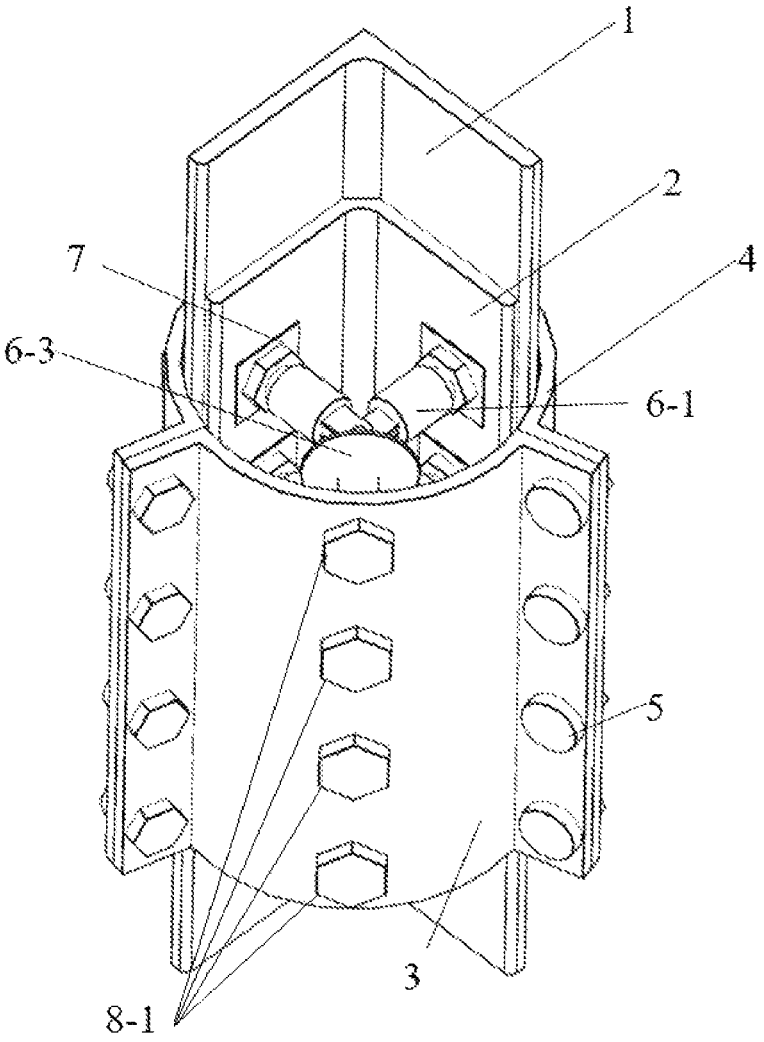
FIG. 1 is a schematic diagram of a device for reinforcing a member bar of an angle iron of a bolt-bearing circumferential device for reinforcing and correcting the angle iron of a transmission tower.
Figure 2:
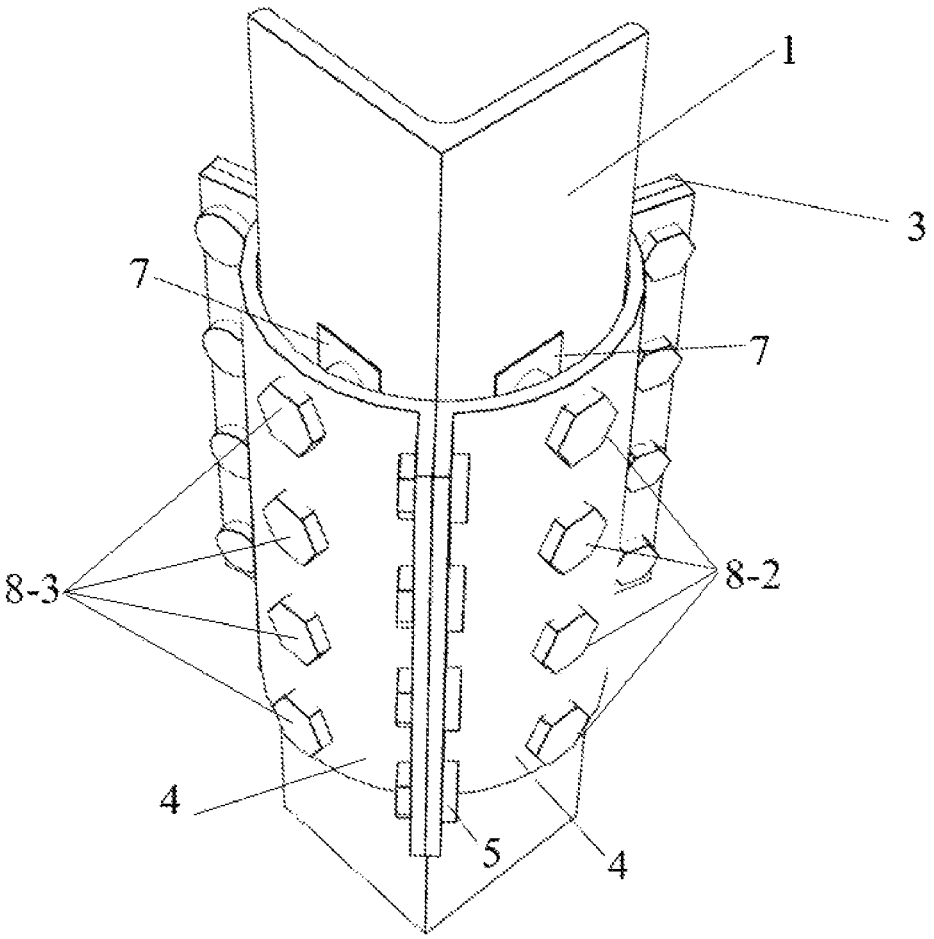
FIG. 2 is a schematic diagram of the device for reinforcing the member bar of the angle iron of the bolt-bearing circumferential device for reinforcing and correcting the angle iron of the transmission tower.
Figure 3:
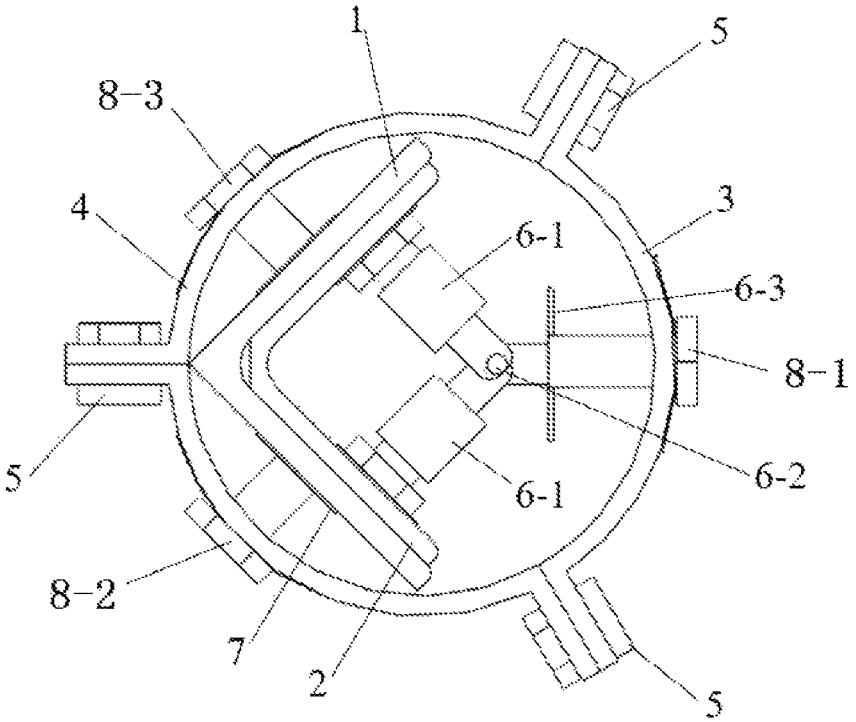
FIG. 3 is a top view of the bolt-bearing circumferential device for reinforcing and correcting the angle iron of the transmission tower.

In a typical embodiment of the present application, as shown in FIG. 2, the plane in which the section is located is defined as the XY plane, and the axial direction of the angle iron to be reinforced is defined as the Z direction, wherein the Z axis is perpendicular to the XY plane.

The example discloses a bolt-bearing circumferential device for reinforcing and correcting the angle iron of a transmission tower, mainly including a reinforcing angle iron 2, a first holding hoop 3, a second holding hoop 4, high strength bolts 5, a connector, a rubber gasket 7, a bolt 8-1, a bolt 8-2, a bolt 8-3, etc., wherein the reinforcing angle iron 2 is arranged on an inner side of an angle iron to be reinforced 1, a direction of the axis of the reinforcing angle iron 2 is same as that of the angle iron to be reinforced 1; the holding hoops are arranged in an outer ring of the reinforcing angle iron 2 and the angle iron to be reinforced 1, the bolt 8-1 through the holding hoop to apply force to the connector, then the connector to apply force to the reinforcing angle iron 2; the bolt 8-2 and the bolt 8-3 through the holding hoop to apply force to the angle iron to be reinforced 1, that is, the holding hoops form an extrusion with the angle iron to be reinforced 1 through the bolt 8-2 and the bolt 8-3, the bolt 8-1 and the connector also forms an extrusion with the reinforcing angle iron 2.

Specifically, there are three groups of threaded holes provided on a side wall of the holding hoops, the axes of a left group of the threaded holes and a right group of the threaded holes are perpendicular to each other, and the third group of the threaded holes corresponds to the same spacing distribution as the left and right groups of the threaded holes; and each the group of the threaded holes includes a plurality of threaded holes arranged in the same direction along the length of the angle iron to be reinforced 1, and the bolt is correspondingly installed in each the threaded hole.

In example, the angle iron to be reinforced 1 is squeezed between the reinforcing angle iron 2 and the holding hoops, and a rubber gasket is added at the contact part between the bolt and the connector and the angle iron to be reinforced 1, so as to prevent the angle iron members from being damaged and increase the friction force between the bolt and the angle iron during the tightening process, and prevent the reinforcing device from moving along the axis direction of the member bar.

Further, a thickness of the reinforcing angle iron 2 is less than or equal to a thickness of the angle iron to be reinforced 1.

Further, a plurality of holding hoops can be sequentially arranged at equal intervals along the axial direction, and the reinforcing effect can be adjusted by increasing or reducing the number of the holding hoops.

Further, the reinforcing angle iron 2 is subjected to angle cutting treatment, so that the reinforcing angle iron is attached to the reinforced steel.

Figure 4:
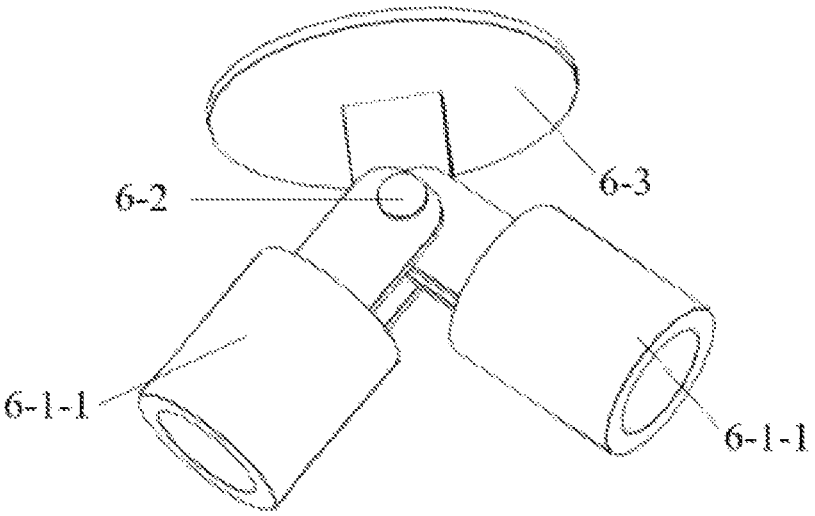
FIG. 4 is a schematic diagram of a connector of the bolt-bearing circumferential device for reinforcing and correcting the angle iron of the transmission tower.
Figure 5:
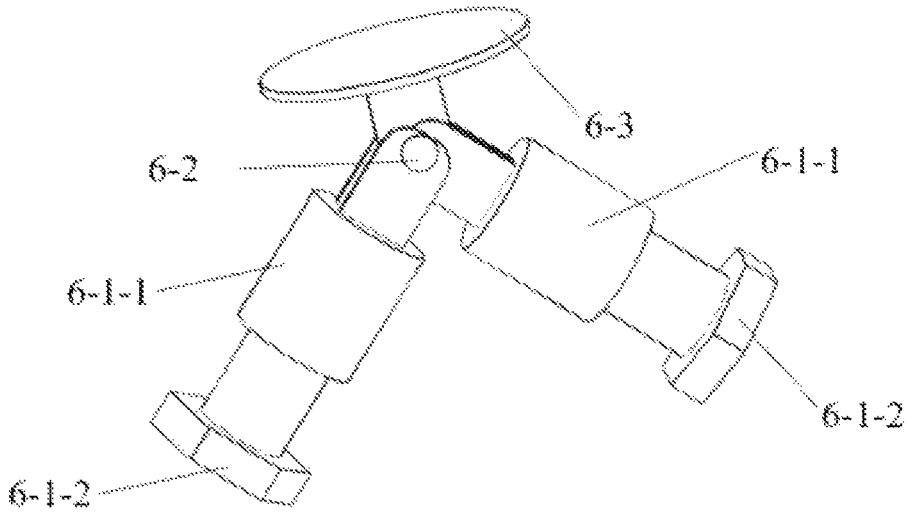
FIG. 5 is a schematic diagram of a connector of the bolt-bearing circumferential device for reinforcing and correcting the angle iron of the transmission tower.

Further, the connector is shown in FIGS. 4 and 5, including a connector support 6-1, a pin shaft 6-2 and a support spacer 6-3, wherein the support spacers 6-3 are connected with the two connector supports 6-1 through the pin shafts 6-2, and the two connector supports 6-1 and the support spacers 6-3 can rotate around the pin shafts to adjust the reinforcement effect.

Further, the connector support 6-1 includes a bolt sleeve 6-1-1 and a bolt 6-1-2, the bolt sleeve 6-1-1 is matched with the bolt 6-1-2, and a length of the bolt 6-1-2 can be adjusted by rotating the bolt sleeve 6-1-1, so that the adjustment of a length of the connector support 6-1 is realized, and the support constraint on any position of the reinforcing angle iron is realized.

Further, the holding hoop consists of three parts of equally divided arc steel plates, and the arc steel plates are connected to each other through high-strength bolts 5; a curvature of the holding hoop is determined according to a length of the limb of the angle iron to be reinforced, so that the holding hoop can be fitted with the angle iron to be reinforced; in example, the three parts of the holding hoop are respectively: a first holding hoop 3 and two second holding hoops 4, wherein a central position of the first holding hoop 3 is provided with threaded through holes, a non-central position of the second holding hoop 4 is provided with threaded through holes, and the axes of the threaded through holes of the two second holding hoops 4 are perpendicular to each other.

When the angle iron to be reinforced 1 is subjected to an axial tensile force or pressure, for the cross-section of the member bar, the stress on the angle iron to be reinforced 1 can be effectively dispersed to the reinforcing angle iron 2 by adding the reinforcing device of the example; and for the weak cross-section of the angle iron to be reinforced 1, the stress thereon can be effectively dispersed to the reinforcing angle iron 2 and the holding hoop clamps, so that the stress on the angle iron to be reinforced 1 is reduced, and the original constructional element (i.e. the main stressed angle iron members) is prevented from being subjected to compression buckling. Moreover, when the original constructional element loses stability or local buckling occurs, the reinforcing angle iron 2 can increase the compression section area of the angle iron members, so that the bearing capacity and the stability of the angle iron to be reinforced 1 are improved. Meanwhile, when the angle iron to be reinforced 1 is compressed, the bolts can play a role of a stiffening rib, and the reinforcing device arranged in the compression area can play a role in improving the buckling critical stress of the compression member and inhibiting the buckling deformation.

According to the device, proposed a novel method for reinforcing and correcting member bars of the transmission tower based on the basic principle of steel structure design, can adapt to the action of various load modes, and effectively improves the overall stable bearing capacity of the transmission tower.

According to the device, there is no need to drill holes in the original members of the transmission tower on site, so the problems the difficulty of construction caused by the great difficulties in obtaining electricity for construction due to the locations of some transmission towers to be reinforced are in remote areas are effectively solved.

According to the device, there is no need to temporarily disassemble the original forced components, so that the iron tower is prevented from being in a dangerous state in the reinforcing process due to redistribution of stress.

According to the device, the structure is simple, convenient to maintain, and obvious in effect, and can effectively improve the bear capacity and the overall stability of the member bar of the transmission tower.

The above embodiments of the patent do not limit the protection scope of the present invention, and the implementation mode of the patent is not limited thereto. All other modifications, substitutions or alterations made to the above structure of the patent in various forms according to the above contents of the patent, according to the common technical knowledge and customary means in the field, without departing from the basic technical idea of the patent, shall fall within the protection scope of the patent.

What is claimed is:

1. A bolt-bearing circumferential device for reinforcing and correcting an angle iron of a transmission tower, comprising a reinforcing angle iron, a holding hoop, and a connector; the reinforcing angle iron is arranged at an inner side of two limbs of an angle iron to be reinforced, an axis direction of the reinforcing angle iron is parallel to the angle iron to be reinforced, and an outer wall of two limbs of the reinforcing angle iron are fitted with an inner wall of the angle iron to be reinforced; the holding hoop is arranged at an outer side of the reinforcing angle iron and the angle iron to be reinforced, and each part of the holding hoop are connected together through high-strength bolts;

a side wall of the holding hoop is provided with three groups of threaded holes, wherein an axis of a first group of the threaded holes and an axis of a second group of the threaded holes are perpendicular to each other, a first group of bolts pass through the first group of the threaded holes to apply a reinforcing force to an outer side of a first limb of the angle iron to be reinforced, and a second group of bolts pass through the second group of the threaded holes to apply a reinforcing force to an outer side of a second limb of the angle iron to be reinforced; and, a third group of bolts pass through a third group of the threaded holes to apply a reinforcing force to the reinforcing angle iron through the connector, wherein the connector comprises two connector supports, a pin, and a support spacer, the support spacer is connected to the two connector supports via the pin, and the two connector supports and the support spacer are able to rotate around the pin.

2. The device as claimed in claim 1, wherein each connector support comprises a bolt sleeve and a bolt, a first end of the bolt sleeve is connected to the pin and a second end of the bolt sleeve is matched with a bolt being pressed against the reinforcing angle iron.

3. The device as claimed in claim 1, wherein the holding hoop comprises three parts of equally divided arc steel plates, and the arc steel plates are connected to each other through the high-strength bolts.

4. The device as claimed in claim 1, wherein a curvature of the holding hoop is determined according to a length of one of the first and second limbs of the angle iron to be reinforced, so that the holding hoop can be fitted with the angle iron to be reinforced.

5. The device as claimed in claim 1, wherein a rubber gasket is provided at a contact part between the connector and the angle iron to be reinforced.

6. The device as claimed in claim 1, wherein a rubber gasket is provided at a contact part between the first group of the bolts, the second group of the bolts and the angle iron to be reinforced.

7. The device as claimed in claim 1, wherein the reinforcing angle iron is subjected to an angle cutting treatment.

8. The device as claimed in claim 1, wherein a thickness of the reinforcing angle iron is less than or equal to a thickness of the angle iron to be reinforced.

* * * * *